United States Patent [19]

Willman

[11] Patent Number: 4,735,738

[45] **Date of Patent: * Apr. 5, 1988**

[54] ARTICLE WITH LAMINATED PAPER ORIENTATION FOR IMPROVED FABRIC SOFTENING

[75] Inventor: Kenneth W. Willman, Fairfield, Ohio

[73] Assignee: The Procter & Gamble Company, Cincinnati, Ohio

[ * ] Notice: The portion of the term of this patent subsequent to Jan. 27, 2004 has been disclaimed.

[21] Appl. No.: 789,589

[22] Filed: Oct. 21, 1985

[51] Int. Cl.[4] ..... C11D 17/00; D06M 21/02

[52] U.S. Cl. ..... 252/90; 252/8.8; 252/91; 427/242; 428/170; 428/171

[58] Field of Search ..... 252/90, 91, 92, 94, 252/8.6, 8.8; 427/242; 428/170, 171

[56] References Cited

U.S. PATENT DOCUMENTS

| | | | |
|---|---|---|---|
| 1,075,210 | 10/1913 | Heyl et al. | 252/99 |
| 3,414,459 | 12/1968 | Wells | 161/131 |
| 4,113,630 | 9/1978 | Hagner et al. | 252/8.6 |
| 4,259,383 | 3/1981 | Eggensperger et al. | 428/78 |
| 4,348,293 | 9/1982 | Clarke et al. | 252/90 |
| 4,410,441 | 10/1983 | Davies et al. | 206/0.5 |
| 4,416,791 | 11/1983 | Haq | 252/90 |
| 4,433,783 | 2/1984 | Dickinson | 206/484 |
| 4,529,480 | 7/1985 | Trokhan | 162/109 |
| 4,555,354 | 11/1985 | Clarke et al. | 259/90 |
| 4,638,907 | 1/1987 | Bedenk et al. | 206/0.5 |
| 4,652,390 | 3/1987 | Strampach et al. | 252/92 |

FOREIGN PATENT DOCUMENTS

| | | |
|---|---|---|
| 0066463 | 12/1982 | European Pat. Off. . |
| 0144186 | 6/1985 | European Pat. Off. . |

*Primary Examiner*—Paul Lieberman
*Assistant Examiner*—Linda D. Skaling
*Attorney, Agent, or Firm*—Leonard Williamson; Richard C. Witte

[57] ABSTRACT

The invention relates to an article comprising mobile or immobilized softener composition contained inside laminated plies, which plies are oriented for improved dryer fabric softening and antistatic performance when placed in a dryer with a load of wet fabrics. More specifically, the invention relates to an article comprising releasable fabric softener enclosed inside a flexible water-permeable two ply laminate wherein one of said plies is a first ply which comprises a special tissue which is oriented so that the second ply is less readily absorbent to molten fabric softener than the first ply, whereby the laminate provides improved fabric softening and antistatic performance.

32 Claims, 8 Drawing Sheets

ARTICLE WITH LAMINATED PAPER ORIENTATION FOR IMPROVED FABRIC SOFTENING

FIELD OF THE INVENTION

The invention relates to laminated fabric conditioning laundry actives for washer and dryer use.

BACKGROUND OF THE INVENTION

U.S. Pat. No. 4,529,480, Trokhan, issued July 16, 1985, incorporated herein in its entirety, discloses a special tissue paper and a process used to make the tissue paper, which process can be used to make a preferred paper tissue useful in the present invention. This patent does not specifically teach or suggest that oriented paper would be useful for laminated laundry softener products.

U.S. Pat. No. 4,113,630, Hagner et al., issued Sept. 12, 1978, discloses a laundry article utilizing a water-insoluble substrate which is added to the automatic washer, and is subsequently carried into the dryer with the fabrics in order to provide them with fabric softening and static control benefits. The laundry substrate articles have the softening and static control mixture (softener dots) penetrating into the substrate and extending above the substrate to a height of from about 1/32 inch to about ½ inch. Laminated articles are disclosed and a method for obtaining softening and static control benefits, using these articles, is also disclosed in Hagner et al. There is no mention of paper orientation as defined herein for improved fabric softening performance.

U.S. Pat. No. 4,410,441, Davis et al., issued Oct. 18, 1983, recognizes the need to separate materials to provide faster release and controlled release of storage incompatible materials. It discloses laminating two different materials into two large pouches. Typically, dry powders are laminated between a water-permeable substrate and a water-impermeable substrate. Examples of other prior art laminates are found in U.S. Pat. No. 4,259,383, Eggensperger et al., issued Mar. 31, 1981; U.S. Pat. No. 4,433,783, Dickinson, issued Feb. 28, 1984; U.S. Pat. No. 4,348,293, Clarke et al., issued Sept. 7, 1982. Also U.S. Pat. No. 4,416,791, Haq, which issued Nov. 22, 1982, discloses a packaging film which contains liquid detergent products. U.S. Pat. No. 4,437,294, Romagnoli, issued Mar. 20, 1984, discloses a volumetric batching device for pouches.

A need is recognized to separate materials to provide fast release or controlled release of incompatible materials. EPA No. 66,463, Haq, Dec. 8, 1982, discloses a laminated material in a sandwich heat-sealed structure to provide separate compartments and perforations for release of the active materials.

In another reference, multi-compartmentalized laminated disinfecting materials comprising minipouches are disclosed in U.S. Pat. No. 4,259,383, supra. This patent does not teach paper orientation for improved fabric softener performance.

European Patent Application No. 0144186, Leigh et al., published June 12, 1985, discloses the conditioning of fabrics in tumble dryers plus using a sachet containing free-flowing fabric conditioning composition with a restricted number of openings.

There is no mention or suggestion in any of the above background patents of paper orientation as defined herein for improved fabric softening performance.

OBJECTS

An object of the present invention is to make an improved, compact, as well as an efficient, laminated laundry fabric softener (softener/antistatic mixtures) product which can survive the wash with improved softener release in the dryer.

Another object of the present invention is to impregnate (immobilize) fabric softener as "dots" on "oriented" laminated tissue paper to maximize softening/antistatic performance.

Still another object of the present invention is to provide a superior laminated softener/antistatic product for consumer use which contains effective amounts of chemical agents which soften and condition fabric in a laundry dryer in a convenient laminated sheet form.

Other objects will become apparent from the following disclosure.

SUMMARY OF THE INVENTION

The invention relates to a flexible water-permeable laminated laundry article comprising two insoluble laminated plies, with fabric softener composition releasably contained within said laminate, wherein one of said plies is a first ply which comprises a paper tissue having a distinct continuous high density network region and a plurality of low density domes dispersed throughout said network region, said domes appearing to be protuberances when viewed from one surface of said tissue paper and cavities when viewed from the opposite surface, wherein said high density network region is more readily absorbent to said fabric softener when said fabric softener is molten than the low density domes; wherein said first ply is oriented with its low density domes facing outwardly of the laminate, and wherein said second ply is a suitable sheet selected from: tissue paper, nonwoven fabrics, plastic films, woven fabrics, and the like, and wherein said second ply is less readily absorbent to said molten fabric softener than said oriented first ply.

BRIEF DESCRIPTION OF THE DRAWINGS

Although FIGS. 4, 5, 6 and 7 are shown flat, it is understood that the molds may also be mounted on a circular drum, as shown in FIGS. 9 and 10. Thus, flat mold (14) and mold-depositing drum (14) shown in FIGS. 9 and 10 are both numbered (14) for simplicity.

DETAILED DESCRIPTION OF THE INVENTION

Figure 1:
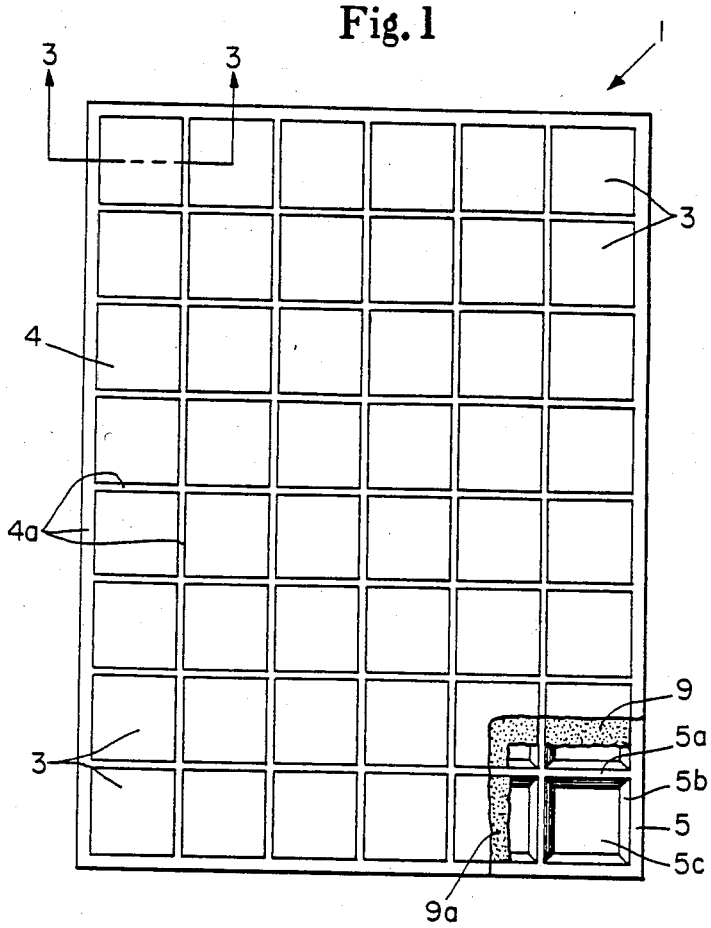
FIG. 1 is a top view of a preferred laminated laundry product (1) showing the tops of a multiplicity of nonconnecting cells (3) containing powdered laundry actives (9 and 9*a*) and cups (5*c*) in the cutaway section.

The invention relates to a flexible water-permeable laminated laundry article comprising two insoluble laminated plies, with fabric softener composition releasably contained within said laminate, wherein one of said plies is a first ply which comprises a paper tissue having a distinct continuous high density network region and a plurality of low density domes dispersed throughout said network region, said domes appearing to be protuberances when viewed from one surface of said tissue paper and cavities when viewed from the opposite surface, wherein said high density network region is more readily absorbent to said fabric softener when said fabric softener is molten than the low density domes; wherein said first ply is oriented with its low density domes facing outwardly of the laminate, and wherein said second ply is a suitable sheet selected from: tissue paper, nonwoven fabrics, plastic films, woven fabrics, and the like, and wherein said second ply is less readily absorbent to said molten fabric softener than said oriented first ply.

The laminated laundry article comprises two plies at least one of which is a tissue with laundry softener and antistatic agents contained inside the laminate. For purposes of describing the present invention, the term "softener" will be understood to include both fabric softener and antistatic agents. A preferred embodiment of the invention is well-illustrated in the drawings.

U.S. Pat. No. 4,529,480, Trokhan, issued July 16, 1985, incorporated herein by reference, discloses a tissue paper and a process used to make the preferred tissue paper used to make the oriented laminated paper products of this invention. The process comprises forming an aqueous dispersion of the papermaking fibers which is formed into an embryonic web on a first foraminous member such as a Fourdinier wire. This embryonic web is associated with a second foraminous member known as a deflection member. The surface of the deflection member with which the embryonic web is associated has a macroscopic monoplanar, continuous patterned network surface which defines within the deflection member a plurality of discrete, isolated deflection conduits. The papermaking fibers in the web are deflected into the deflection conduits and water is removed through the deflection conduits to form an intermediate web. Deflection begins no later than the time water removal through the deflection member begins. The intermediate web is dried and foreshortened as by creping. The paper web has a distinct continuous network region and a plurality of domes dispersed throughout the whole of the network region. These "domes" appear to be protuberances when viewed from one surface of the paper and "cavities" when viewed from the other surface. The "domed" surface of the tissue is less readily absorbent to molten fabric softener than the relatively higher density "cavitied" surface of the tissue.

The network is continuous, is macroscopically monoplanar, and forms a preselected pattern. It completely encircles the domes and isolates one dome from another. The domes are dispersed throughout the whole of the network region. The network region has a relatively low basis weight and a relatively high density, while the area of each dome has a relatively high basis weight and a relatively low density. Further, the domes exhibit relatively low intrinsic strength while the network region exhibits relatively high intrinsic strength.

While not being bound to any theory, it is theorized that more of the molten fabric softener is released from said oriented first ply of the laminate when softener absorption competition from the second ply is minimal. Thus, the term "less readily absorbent" means that the absorption and migration of the molten fabric softener in and throughout the second ply is slower than it is in the first ply.

It is also theorized that the embossing of a tissue ply whether from the domed surface or the cavitied surface results in an increase in molten fabric softener release due to a resultant increase in the porosity of the embossed tissue. Thus, a preferred embodiment of the invention includes at least one embossed ply. It is further theorized that more molten fabric softener is released through the cavities than through either the high density network or through the domes when the domes are oriented on the inside of the laminate.

The preferred laundry softener article comprises two laminated plies of the paper tissue and solid fabric softener in between said two plies. The plies are laminated with one ply having its domes inward and the other ply having its domes outward to provide improved softener release when placed in a dryer.

The "article" with laminated paper orientation for improved fabric softening is a laminated sheet and is referred to herein as a laminate, a sheet and a product.

Thus, the terms, "laminate," "article," "sheet" and "product" are used herein as synonyms, unless otherwise specified.

Figure 3:
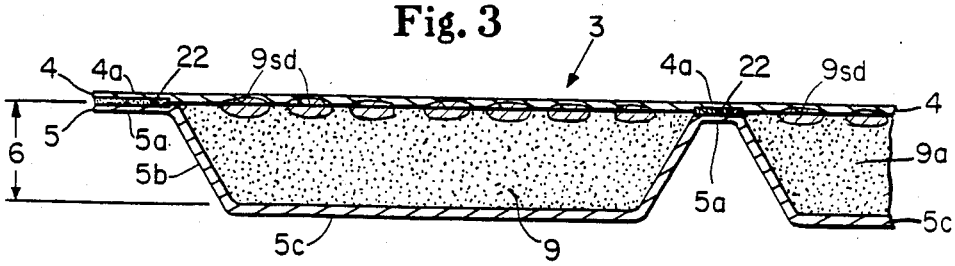
FIG. 3 is a cross-sectional view (3-3) of one of the laminated cells including deeply embossed tissue (5) with nonconnecting cups (2) containing different powdered laundry actives (9 and 9*a*) and a top tissue (4) having softener/antistatic dots (9*sd*) immobilized thereon.

Referring to the drawings, FIG. 1 shows a top view of a laminated laundry article (1). In FIG. 3, the top ply (sheet) tissue (4) is shown with softener dots (9*sd*). FIG. 1 also shows a multiplicity of cells (3) which contain powdered laundry actives as shown in FIG. 3.

Figure 2:
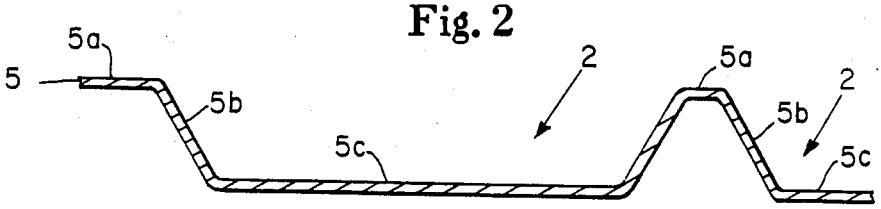
FIG. 2 shows a cross-sectional macroscopic view of an embossed tissue (5) showing nonconnecting cup-like indentations (2).

FIG. 2 shows a deeply embossed bottom ply tissue (5) with cup-like rims (5*a*), sides (5*b*) and bases (5*c*). FIG. 3 is a cross-sectional view along lines 3—3 of FIG. 1. The bottom tissue (5) is stretched preferably about 15% up to about 100%, and typically about 25% to about 90%, to a cup depth (6) of about 2 to 15 mm or more, preferably 6 to 12 mm. The tissue (5) is embossed (stretched) to form a multiplicity of patterned cups (2) which can have sides (5*b*) and a base (5*c*) of cells (3) and with the tops composed of a top tissue (4). The cells are pattern sealed with glue (22) at cup rims (5*a*) and top tissue (4*a*). Different powdered laundry actives (9 and 9*a*) can be contained inside the sealed cells (3). Thus, storage incompatible laundry actives can be physically separated in the rows of cells. Of course, powdered fabric softener, prills or flakes, can be placed in the cells, but immobilized softener dots (9*sd*) as disclosed herein are preferred.

Figure 4:
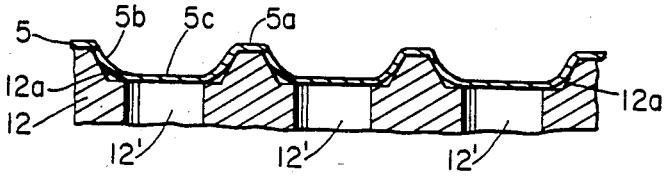
FIG. 4 shows the vacuum mold (12) and the embossment of a tissue (5) whereby the tissue (5) is pulled and stretched into mold cavities (12*a*) over mold land (12*b*) with vacuum (12').
Figure 5:
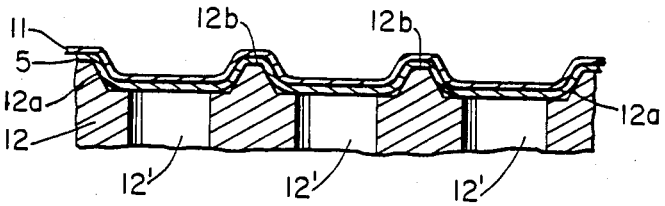
FIG. 5 is the same as FIG. 4 with the addition of a nonporous flexible embossing sheet (11) which seals the vacuum for more effective embossing.

FIGS. 4, 5, 6 and 7 show several methods of embossing the bottom tissue (5) to form the nonconnecting cups. FIG. 5 shows tissue (5) being embossed by vacuum mold (12) using vacuum (12') and a nonporous topsheet (11). The vacuum pulls the nonporous sheet down forcing the tissues down. The tissue (5) is stretched at least about 15% up to about 100% into the mold cavities (12*a*) over mold lands (12*b*).

FIG. 4 shows vacuum embossment without a topsheet. Tissue (5) is sucked into the mold cavity (12*a*) using only vacuum.

Figure 6:
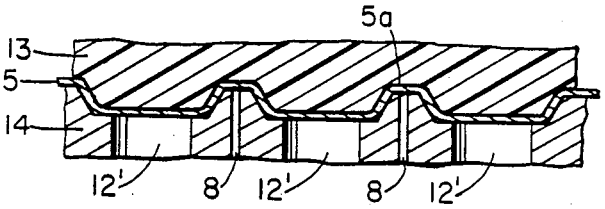
FIG. 6 is a cross-sectional view of a soft rubber embosser (13).
Figure 7:
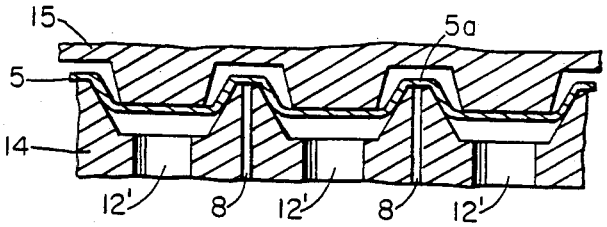
FIG. 7 is a cross-sectional view of a hard embosser (15).
Figure 9:
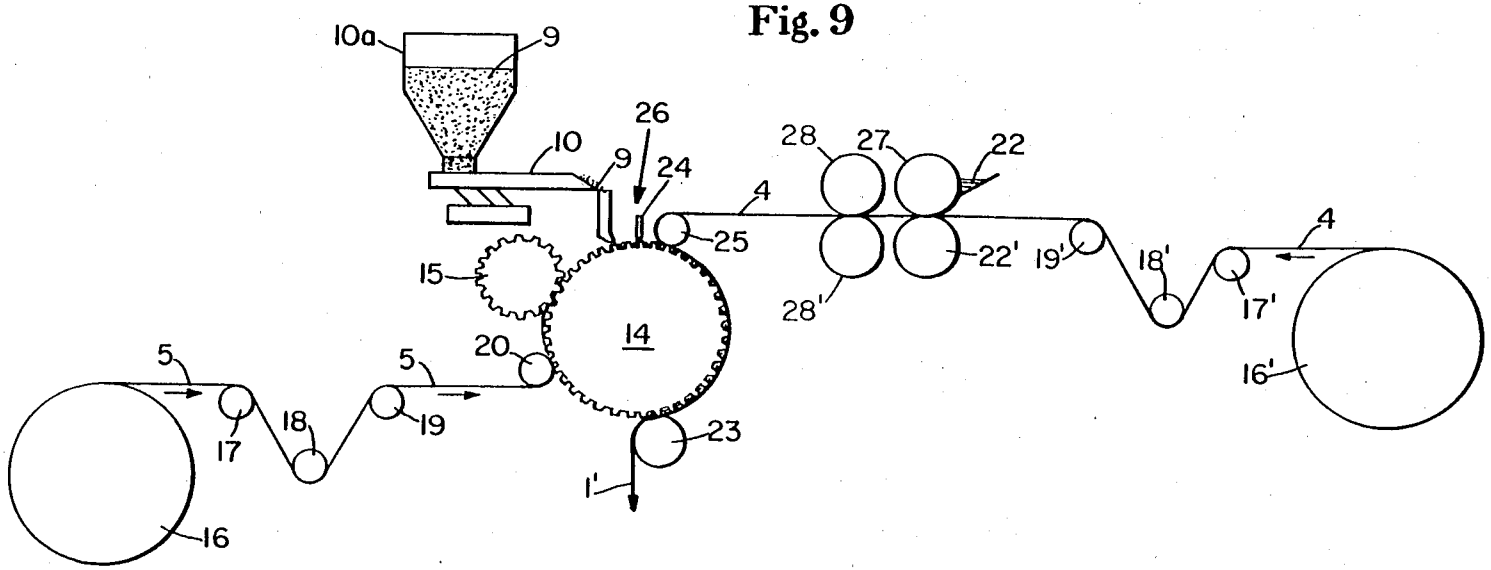
FIG. 9 is a schematic flow diagram of a continuous process for making the laminated laundry product of the present invention.
Figure 10:
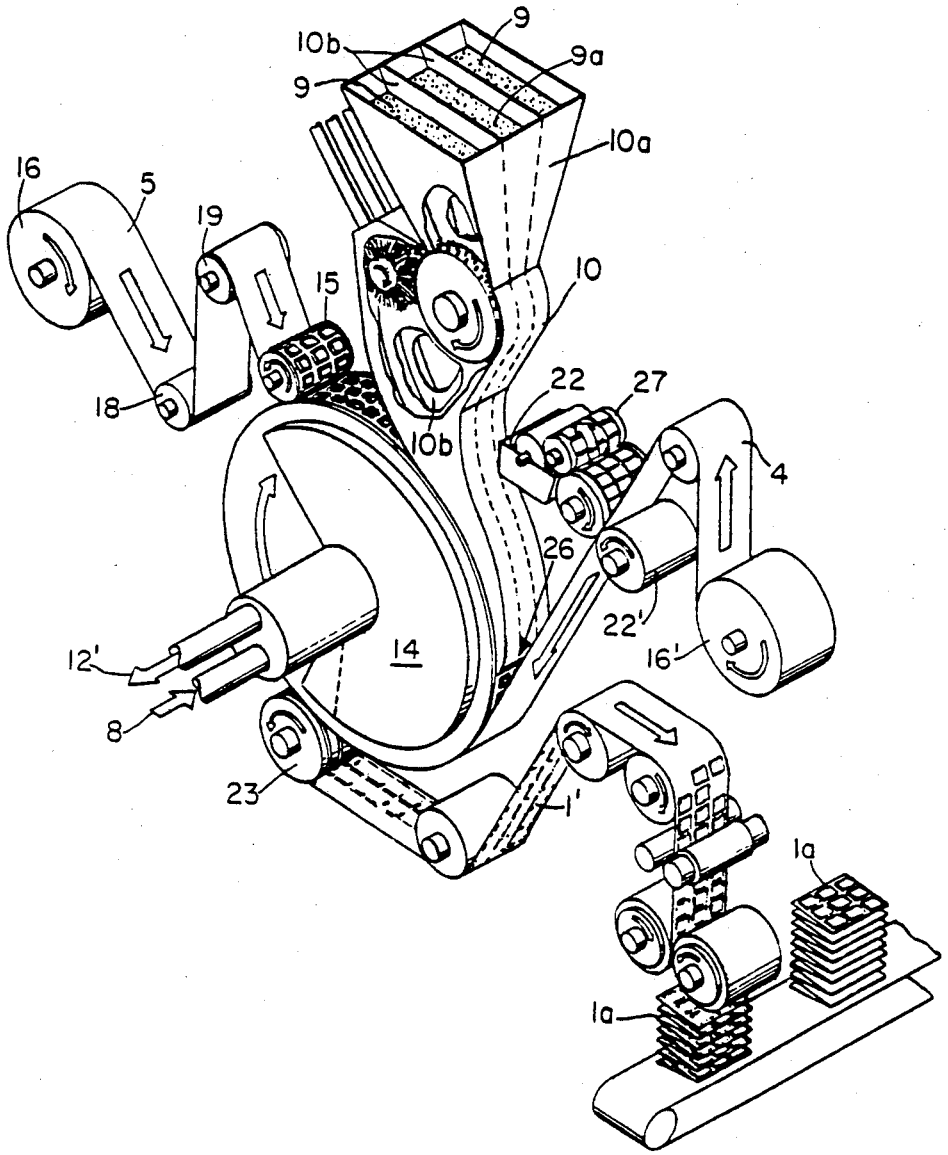
FIG. 10 is a pictorial perspective of a continuous process like that shown in FIG. 9.

FIG. 6 shows a preferred soft rubber embosser (13), tissue (5), and mold (14) with vacuum (12') and blow air (8). The blow air (8) can be used to help remove powder from cup rims (5*a*) in a continuous process as shown in FIGS. 9 and 10. FIG. 7 shows a hard embosser (15) and a mold (14) as also shown in FIG. 6.

Figure 8:
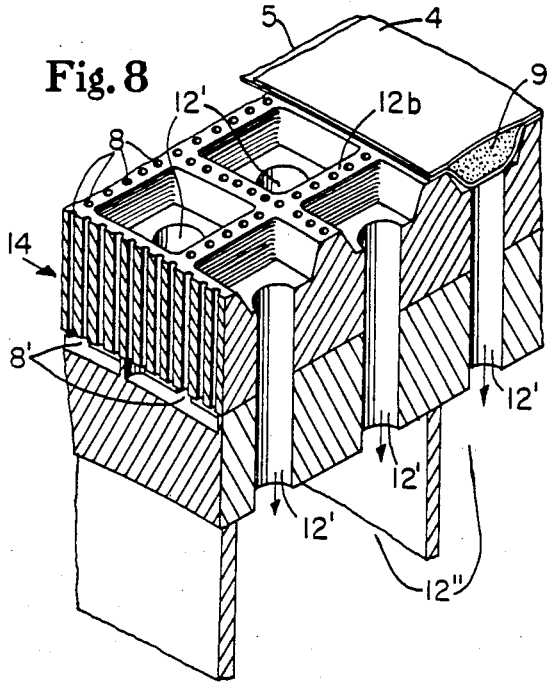
FIG. 8 is a perspective cross-sectional view of the mold of FIG. 6 or 7 showing vacuum (12'), vacuum chamber (12''), blow air (8) and blow air channels (8').

FIG. 8 is a pictorial perspective cross-sectional view of the mold of the type shown in FIGS. 6 and 7.

FIG. 9 shows a preferred schematic continuous process for making the preferred laminated laundry article of this invention. A bottom tissue unwind roll (16) with rolls (17, 18, 19, and 20) which control tension and guide the web of tissue (5) onto the mold-depositing drum (14). The orientation of bottom tissue (5) is preferably such that the above-defined domes face the top ply (4) and inside the laminate. In such a case, the top ply (4) would then be oriented first ply and its above-defined domes would be facing the outside of the laminate and its cavitied surface facing the bottom tissue (5). This paper orientation is abbreviated herein as "C/D," meaning top ply cavities in, bottom ply domes in. In this orientation the "C" oriented "first" or top ply is more absorbent to molten fabric softener than the "D" oriented "second" or bottom ply.

A hard embosser (15), embosses the tissue (5) as shown in FIG. 7. A soft rubber embosser (13) as shown in FIG. 6 could be substituted for the hard embosser. The tissue stretched with a soft embosser is more uniformly stretched into the cup cavity. Laundry powder feeder conveyor (10) deposits metered amounts of powdered laundry actives (9) into cups (2) as shown in FIG. 2. A doctor knife (24) wipes the powder off the cup rims (5*a*). The doctor knife (24) can be plastic, metal or preferably a soft brush. Blow air (8) as shown in FIG. 6 can also be used to assist in cleaning the cup rims (5*a*) of powder.

FIG. 9 also shows a top tissue unwind roll (16') with rolls (17', 18' and 19') which control tension and guide the top web tissue (4) through a patterned hot melt adhesive applicator (27) and backup roll (22'). The top web tissue (4) is further guided through a hot-melt-softener and antistatic-dot-mixture applicator (28) and backup roll (28'). The top web tissue (4) is further guided around roll (25) to laminating roll (23) which laminates the two plies of tissue together with the top ply having its cavitied surface and softener dots face inward and and the bottom ply (5) having its domed surface inward to form a continuous web of laminated laundry article (1') with oriented paper which is then cut into convenient sized sheets (not shown, but illustrated in FIGS. 1, 10 and 15).

FIG. 10 is one embodiment of an apparatus similar to the flow diagram shown in FIG. 9. In this embodiment, the softener is not immobilized as dots, but added as loose prills to the laminate sheets. Convenient sized sheets (1*a*) each with nine cells are shown. The numbered elements in FIG. 10 correspond to those of FIG. 9 described above with 9*a* being shown.

Figure 15:
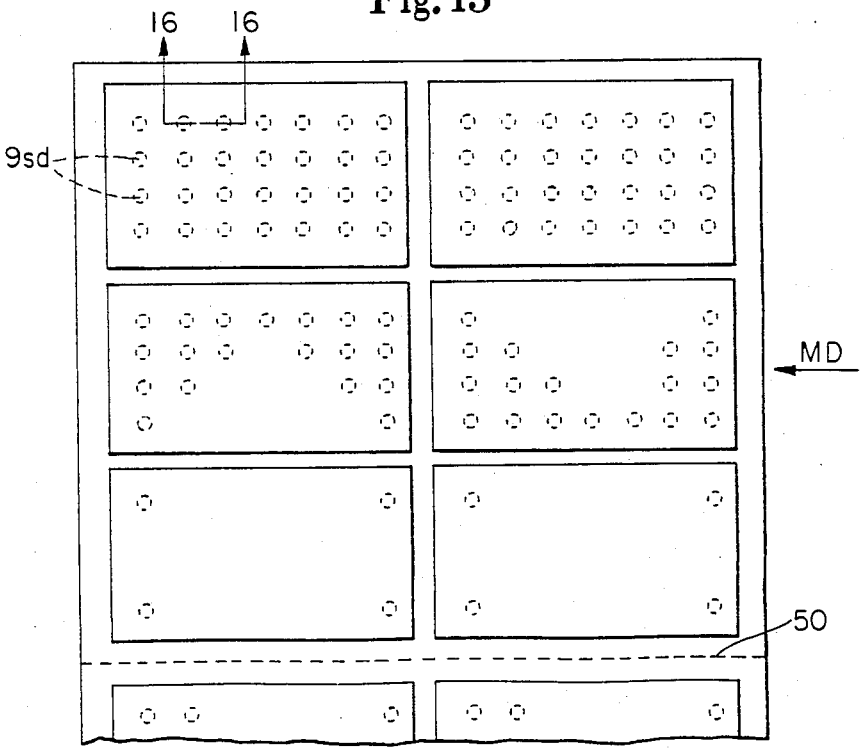
FIG. 15 is a top view of a laminated laundry article like the one shown in FIG. 1 but for larger and fewer cells (33) per laminate sheet with patterned softener dots (*9sd*) like those shown in FIG. 3.

As shown in FIG. 10, the sheets are preferably cut into rectangular squares which can range from 10 to 80 cm per side and preferably range from 15 to 45 cm per side. The sheets preferably contain a total of 4 to 60 cells, preferably 12 to 48 cells. Each cell preferably contains from 0.5 to 20 cc of powdered laundry actives, and can conveniently hold from 5 to 15 cc of powdered laundry actives. Of course, the sheets may be perforated (50) for easy tearing into separate smaller sheets, as shown in FIG. 15.

Figure 11:
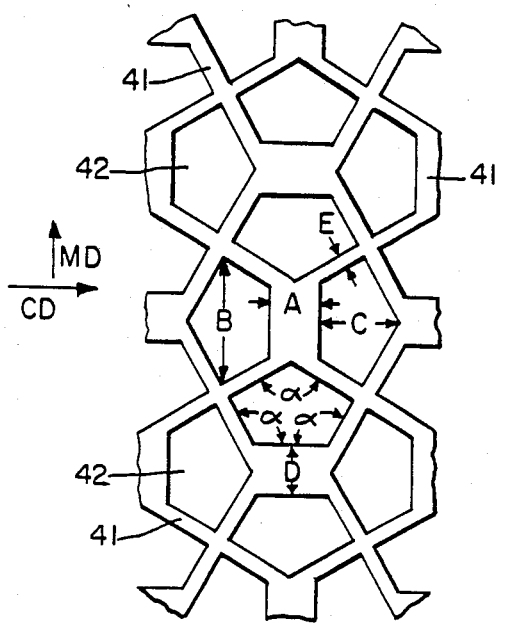
FIGS. 11 and 12 are magnified views of the openings of the deflection conduits of preferred deflection members used for making tissue papers which have a high density region which would correspond to the reference number 41 and the low density domes of the paper which would correspond to reference number 42.
Figure 12:
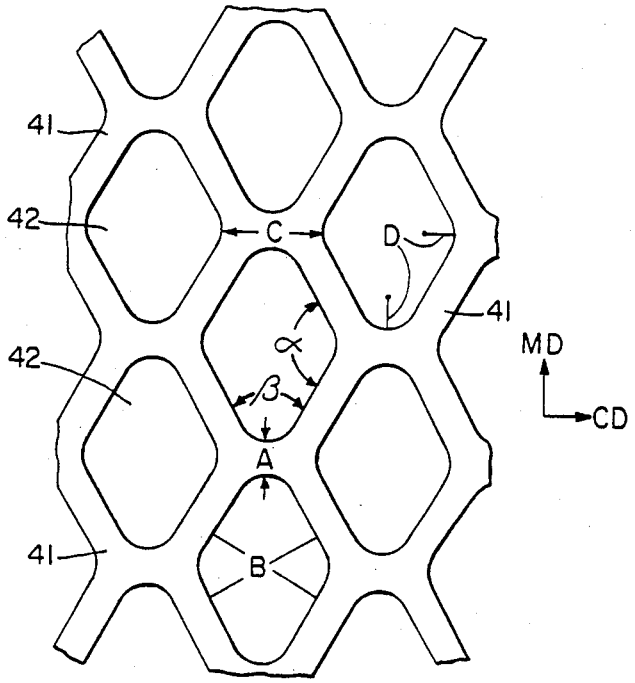

FIGS. 11 and 12 are preferred patterned network surfaces and deflection conduit geometry for papermaking.

Preferably, the embossed tissue web is covered by a macroscopically flat (nonembossed) tissue web. It is understood, however, that it may be desirable to increase the capacity of each cell. This can be accomplished several ways, one of which is making the cell larger, another is by embossing the top web as well as the bottom web, e.g., by using two mold-depositing drums each equipped with vacuum. It is possible to deposit powder on both webs and effectively double the volume of each cell. Of course, the cups may be enlarged and may be different sizes.

The top tissue can be a nonporous ply, but is preferably a porous ply. It is also understood that the top tissue need not have the high stretch capabilities of the embossed tissue. A method and apparatus of manufacturing a laminated laundry article like the one of this invention is disclosed in commonly assigned U.S. patent application Ser. No. 728,070, filed Apr. 29, 1985, Abdul S. Bahrani, now allowed, incorporated herein by reference.

Figure 13:
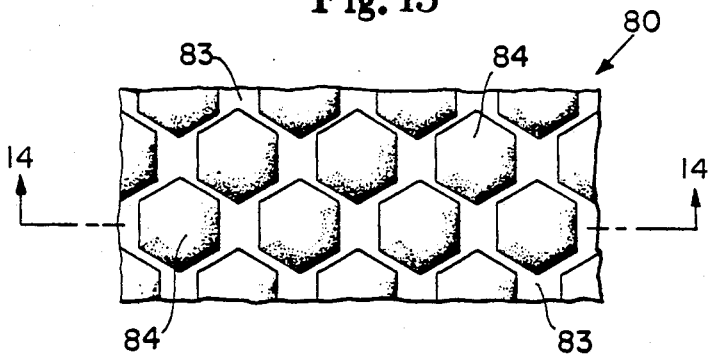
FIG. 13 is a magnified simplified plane view of a portion of a tissue paper web made with the foraminous member comprising a deflection member similar to the one shown in FIG. 12.

FIG. 13 illustrates in plane view a magnified portion of a paper web (80). A high density network region (83) is illustrated as defining low density hexagons, although it is to be understood that other preselected patterns are useful.

Figure 14:
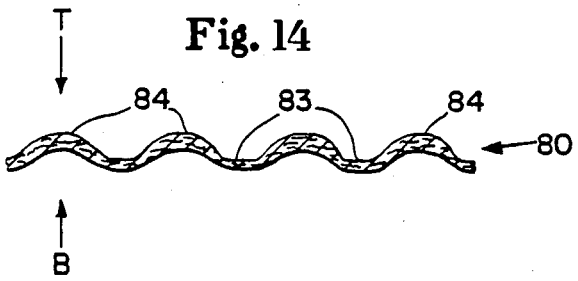
FIG. 14 is a cross-sectional view of a portion of the paper web shown in FIG. 13 as taken along line 14—14 showing domes (84) and high density regions (83).

FIG. 14 is a simplified cross-sectional view of paper web (80) taken along line 14—14 of FIG. 13. As can be seen from FIG. 14, network region (83) is essentially monoplanar.

The second region of the tissue paper web comprises a plurality of domes dispersed throughout the whole of the network region. In FIGS. 13 and 14 the domes are indicated by reference numeral 84. As can be seen from FIG. 13, the domes are dispersed throughout network region (83) and essentially each is encircled by network region (83). The shape of the domes (in the plane of the paper web) is defined by the network region. FIG. 14 illustrates the reason why the second region of the paper web is denominated as a plurality of "domes." Domes (84) appear to extend from (protrude from) the plane formed by network region (83) toward an imaginary observer looking in the direction of arrow T. When viewed by an imaginary observer looking in the direction indicated by arrow B in FIG. 14, the second region comprises arcuate shaped cavities or dimples. The second region of the paper web has thus been denominated a plurality of "domes" for convenience. The paper structure forming the domes can be intact; it can also be provided with one or more holes or openings extending essentially through the structure of the paper web.

One embodiment of this preferred paper has a relatively low network basis weight compared to the basis weights of the domes. That is to say, the weight of fiber in any given area projected onto the plane of the paper web of the network region is less than the weight of fiber in an equivalent projected area taken in the domes. Further, the density (weight per unit volume) of the network region is high relative to the density of the domes.

In a second embodiment, the basis weight of the domes and the network region are essentially equal, but the densities of the two regions differ as indicated above.

In certain embodiments of the preferred paper, the average length of the fibers in the domes is smaller than the average length of the fibers in the network region.

Preferred paper webs of this invention have an apparent (or bulk or gross) density of from about 0.025 to about 0.150 grams per cubic centimeter, most preferably from about 0.040 to about 0.100 g/cc. The density of the network region is preferably from about 0.400 to about 0.800 g/cc, most preferably from about 0.500 to about 0.700 g/cc. The average density of the domes is preferably from about 0.040 to about 0.150 g/cc, most preferably from about 0.060 to about 0.100 g/cc. The overall preferred basis weight of the paper web is from about 9 to about 95 grams per square meter. Considering the number of fibers underlying a unit area projected onto the portion of the web under consideration, the ratio of the basis weight of the network region to the average basis weight of the domes is from about 0.8 to about 1.0.

Other suitable second plies can be selected from the substrates disclosed in U.S. Pat. No. 4,113,630, Hagner et al., issued Sept. 12, 1978, incorporated herein by reference.

DETAILS FOR MAKING THE ARTICLE

1. The Preferred Tissue Paper for at Least the First Ply

In addition to the above, the preferred paper used in the present invention has certain physical characteristics. It has multi-directional strength, wet as well as dry; multi-directional dry stretch (elongation potential) to allow the deep embossing and to allow the article to withstand the rigors of hot machine washing. Specifically, the preferred paper has a dry machine directional (MD) tensile strength of from about 1,200 to about 2,400 grams per inch, preferably at least about 1,400 grams per inch, with from about 30% to about 60% dry stretch, preferably at least about 45% as defined hereinbelow. It has a dry cross-directional (CD) tensile strength of from about 700 to about 1,500 grams per inch, preferably at least about 800 grams per inch, with from about 9% to about 35% stretch, preferably at least about 12% up to about 30%. It has CD wet strength of 200–800 grams per inch, preferably at least about 250 grams per inch.

To obtain these paper characteristics, one can use the process of commonly assigned U.S. Pat. No. 4,529,480, Paul D. Trokhan, modified as described herein. The combination of specifically designed fabrics on which a paper structure could be formed, special creping (wet microcontraction) process and particular wet strength chemicals are required to make paper to fit the needs of this invention.

In papermaking, directions are normally stated relative to machine direction (MD) and cross machine direction (CD). Machine direction refers to that direction which is parallel to the flow of the paper web through the papermaking machine. Measurements in the machine direction are made on the test specimen parallel to that direction. Cross machine direction is perpendicular to a machine direction. Naturally, cross machine direction measurements are made on the test specification in a direction at right angles to the machine direction.

Total tensile is defined as the arithmetic sum of the MD and CD tensiles. The preferred paper should have a dry total tensile of from about 1,800 to about 3,200 grams per inch, preferably at least about 2,000 grams per inch. The ratio of dry MD tensile to dry CD tensile should be from about 1.2 to about 2.2, preferably from about 1.4 to about 2.2.

Distinguished from paper products such as toilet paper, facial tissues, napkins, and the like, which generally have low wet strengths, it should be recognized that the articles of the present invention are intended to be used in an agitated wet system. In this case, for example, the product is placed in a washing machine with a load of fabrics, and remains with the fabrics throughout the washing/rinsing cycles and the drying cycle in a clothes dryer. This is called a "through the wash" embodiment of the present invention. Thus, the paper used in the articles of this invention must have certain properties in the wet state. The preferred paper should exhibit a wet CD tensile strength of from about 200 to about 800 grams per inch, preferably at least about 250 grams per inch. It preferably has a wet burst peak force of from about 200 to about 800 grams, preferably at least about 250 grams. It should be noted that the elongation percentage is determined as part of the wet burst test method and is different from the embossment stretch, with maximum elongation of from about 15% to about 30%, preferably at least about 17%. It preferably should have a wet energy absorption of from 140 to about 220 gram centimeters, preferably from about 160 to about 200 gram centimeters.

The basis weight of the paper is preferably from about 15 to about 35 pounds per 3,000 square feet, most preferably from about 20 to about 28 pounds per 3,000 square feet. (1 pound is about 0.0451 kilograms and 1 square foot=0.092 square meter.)

The paper should have a dry caliper of from about 10 to about 35 mils, preferably from about 20 to about 30 mils. (As used herein, one "mil" is equivalent to 0.001 inch or 0.254 mm.)

Dry tensile strength is obtained with a Thwing-Albert Model OCFM-24 tensile tester such as is available from the Thwing-Albert Instrument Company of Philadelphia, Pa. Product samples measuring 1 in. by 6 in. are cut in both the machine and cross-machine directions. Four sample strips are superimposed on one another and placed in the jaws of the tester which is set at a 4 in. gauge length. The crosshead speed during the test is 4 in. per minute. Readings are taken directly from a digital readout on the tester at the point of rupture and divided by four to obtain the tensile strength of an individual sample. Results are expressed in grams per inch.

Wet tensile strength is measured in a similar manner except the samples are immersed in distilled water at room temperature in a Finch cup.

Stretch is the percent elongation of the strip, as measured at rupture, and is read directly from a second digital readout on the Thwing-Albert tensile tester. Stretch readings are taken concurrently with tensile strength readings. It should be recognized that the stretch method described is standard in the paper industry and is used to compare and specify paper products. Actual stretch limits in the embossing process correlate with the stretch of this standard method but can be considerably higher.

Dry caliper is obtained with a Model 549M motorized micrometer such as is available from Testing Machines, Inc. of Amityville, Long Island, N.Y. Product samples are subjected to a loading of 80 grams per square inch under a 2-inch diameter anvil. The micrometer is zeroed to assure that no foreign matter is present beneath the anvil prior to inserting the samples for measurement and calibrated to assure proper readings. Measurements are read directly from the dial on the micrometer and are expressed in mils.

Wet burst peak force is measured by forcing a $\frac{5}{8}$ inch diameter spherical surface against a circular sample $3\frac{1}{2}$ inches diameter held within an annular clamp. The force required to puncture the sample as the spherical surface is moved through the sample at a constant rate of 5 inches per minute is measured in grams and is the burst strength. Equipment used is the burst tester manufactured by Thwing-Albert Instrument Company. Percent elongation is a measure of the distance the spherical surface moves from first contact with the sample to wet burst relative to an initial height of 10 cm.

It is desirable that the paper exhibit an air permeability of from about 100 to about 300 SCFM, preferably from about 150 to about 250 SCFM, as measured according to ASTM Method D-737.

Papers useful herein can be made from any convenient papermaking fiber. Preferred are softwood fibers liberated from the native wood by the common Kraft papermaking process. Fibers obtained from hardwoods and fibers obtained by the various mechanical and chemimechanical papermaking processes, as well as synthetic papermaking fibers, can also be used.

The requisite strength of the paper can be obtained through the use of various additives commonly used in papermaking. Examples of useful additives include wet strength agents such as urea-formaldehyde resins, melamine formaldehyde resins, polyamide-epichlorohydrin resins, polyethyleneimine resins, polyacrylamide resins, and dyaldehyde starches. Dry strength additives, such as polysalt coacervates rendered water-insoluble by the inclusion of ionization suppressors are also useful herein. Complete descriptions of useful wet strength agents can be found in TAPPI Monograph Series Number 29, *Wet Strength Resin in Paper and Paper Board,* Technical Association of the Pulp and Paper Industry (New York 1965), incorporated herein by reference, and in other common references.

The through the wash embodiment of this invention is preferably made with a tissue having oxidation resistance. One preferred tissue is made with from 0.01% of 5% of an oxidation resistant (OR) wet strength resin, preferably 0.1% to 5%, more preferably 0.1% to 3%, and more practically from 0.5% to 1.5% by weight of the tissue. The preferred resin is made by a process comprising:

Step 1. Reacting in aqueous solution (a) a linear polymer wherein from 5 to 100% of the recurring units have the formula

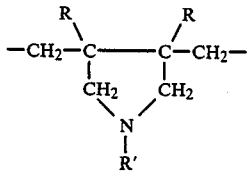

wherein R is hydrogen or lower alkyl and R′ is alkyl or a substituted alkyl group wherein the substituent is a group which will not interfere with polymerization through a vinyl double bond and is selected from the group consisting of carboxylate, cyano, ether, amino, amide, hydrazide and hydroxyl groups with (b) from about 0.5 to about 1.5 moles of an epihalohydrin per mole of secondary plus tertiary amine present in said polymer at a temperature of about 30 to about 80° C. and a pH from about 7 to about 9.5 to form a water-soluble resinous reaction product containing epoxide groups; and then Step 2. reacting the resinous reaction product, in aqueous solution, with from about 0.3 equivalents to about 1.2 equivalents per equivalent of epihalohydrin of a water-soluble acid selected from the group consisting of hydrogen halide acids, sulfuric acid, nitric acid, phosphoric acid, formic acid and acetic acid until the epoxide groups are converted substantially to the corresponding halohydrin groups and an acid-stabilized resin solution is obtained.

These reaction products of epihalohydrin and polymers of diallylamine and salts thereof and their use in paper are disclosed in U.S. Pat. No. 3.700,623, G. I. Keim, issued Oct. 24, 1972, and U.S. Pat. No. 3,833,531, G. I. Keim, issued Sept. 3, 1974, both of which are incorporated herein by reference in their entirety.

As reported in U.S. Pat. No. 3,833,531, specific copolymers which can be reacted with an epihalohydrin include copolymers of N-methyldiallylamine and sulfur dioxide; copolymers of N-methyldiallylamine and diallyamine; copolymers of the diallylamine and acrylamide; copolymers of diallylamine and acrylic acid; copolymers of N-methyldiallylamine and methyl acrylate; copolymers of diallylamine and acrylonitrile; copolymers of N-methyldiallylamine and vinyl acetate; copolymers of diallylamine and methyl vinyl ether; copolymers of N-merthyldiallylamine and vinylsulfonamide; copolymers of N-methyldiallylamine and methyl vinyl ketone; terpolymers of diallylamine, sulfur dioxide and acrylamide; and terpolymers of N-methyldiallylamine, acrylic acid and acrylamide.

The most preferred resin is the HCl stabilized reaction product of epichlorohydrin and poly(N-methyldiallylamine hydrochloride) used at a level of from 0.5% to about 1.5% by weight of the bone dry pulp. Its preferred molecular weight via gel permeation chromatography is about 300,000 to 600,000 and it is made according to the process disclosed herein and similar to that of Example 2 of said U.S. Pat. No. 3,700,623, supra, incorporated herein by reference in its entirety.

As stated above, a specific paper process found particularly useful for making the paper of the present invention is generally described by P. D. Trokhan in U.S. Pat. No. 4,529,480, issued July 16, 1985, incorporated herein by reference. However, the preferred tissue paper used in this invention requires inclusion of the above specified wet strength agents so that the paper can survive a bleach environment along with the rigors of an automatic washing machine and a tumble dryer.

The Trokhan paper web, which is also called a tissue paper web, is characterized as having distinct surfaces. As defined herein, one surface is dominated by the high density network region which is continuous, macroscopically monoplanar, and which forms a preselected pattern. It is called a "network region" in Trokhan because it comprises a system of lines of essentially uniform physical characteristics which intersect, interlace, and cross, like the fabric of a net. It is described as "continuous" because the lines of the network region are essentially uninterrupted across the surface of the web. (Naturally, because of its very nature paper is never completely uniform, e.g., on a microscopic scale. The lines of essentially uniform characteristics are uniform in a practical sense and, likewise, uninterrupted in a practical sense.) The high density network region is described as "macroscopically monoplanar" because, when the web as a whole is placed in a planar configuration with the cavitied surface down, the top surface (i.e., the surface lying on the same side of the paper web as the protrusions of the domes) of the network is also essentially planar. The network region is described as forming a preselected pattern because the lines define (or outline) a specific shape (or shapes) in a repeating (as opposed to random) pattern.

The domes/cavities of the tissue paper web are of a relatively low density. One surface of the web comprises a plurality of the domes dispersed throughout the whole of the network region, each being encircled at its base by portions of the high density network region. The shape of the domes (in the plane of the paper web) is defined by the network region. This low density "domed" surface of the paper web is so denominated for convenience because each one appears to extend from (protrude from) the plane formed by network region when viewed by an imaginary observer examining the tissue paper web from that surface. As mentioned above, when viewed by an imaginary observer examining the tissue paper web from the opposite (high density) surface of the web, the "domes" comprise arcuate shaped voids which appear to be "cavities."

The density (weight per unit volume) of the network region itself is high relative to the density of the domes themselves.

Those skilled in the paper art are familiar with the effect of creping on paper webs. In a simplistic view, creping provides the web with a plurality of microscopic or semi-microscopic corrugations which are formed as the web is foreshortened, the fiber-fiber bonds are broken, and the fibers are rearranged. In general, the microscopic or semi-microscopic corrugations extend transversely across the web. That is to say, the lines of microscopic corrugations are perpendicular to the direction in which the web is traveling at the time it is creped (i.e., perpendicular to the machine direction). They are also parallel to the line of the doctor blade which produces the creping. The crepe imparted to the web is more or less permanent so long as the web is not subjected to tensile forces which can normally remove crepe from a web. In general, creping provides the paper web with extensibility in the machine direction and improves softener delivery. Preferably, the tissue paper web used herein is creped.

2. The Preferred Papermaking Process

Again, the particularly preferred paper web described above can be made according to the process of commonly assigned U.S. Pat. No. 4,529,480, Paul D. Trokhan, modified as described herein.

The first step in the process involves providing an aqueous dispersion of papermaking fibers and papermaking chemicals including wet strength resins and dry strength resins. The fibers and chemicals mentioned above can be used. Techniques well known to those skilled in the papermaking art can be used to prepare this dispersion which is sometimes known as a papermaking furnish.

The second step in the process is forming an embryonic web of papermaking fibers from the papermaking furnish on a first foraminous member. The fibers in the embryonic web have a relatively large quantity of water associated with them; consistencies in the range of from about 5% to about 25% are satisfactory. (Percent consistency is defined as 100 times the quotient obtained when the weight of dry fiber in the system under discussion is divided by the total weight of the system.) The embryonic web is generally too weak to be capable of existing without the support of an extraneous element such as the first foraminous member. The fibers within the embryonic web are held together by bonds weak enough to permit rearrangement of the fibers under the action of forces hereinafter described. Any of the numerous techniques well known to those skilled in the papermaking art can be used in the practice of this step. As a practical matter, continuous papermaking processes are preferred. Processes which lend themselves to the practive of this step are described in many references such as U.S. Pat. No. 3,301,746 issued to Sanford and Sisson on Jan. 31, 1967, and U.S. Pat. No. 3,994,771 issued to Morgan and Rich on Nov. 30, 1976, both incorporated herein by reference. The first foraminous member is a fourdrinier wire.

The third step is associating the embryonic web with a second foraminous member (a "deflection member") which is a continuous belt. The second foraminous member has one surface, the embryonic web-contacting surface, which comprises a macroscopically monoplanar network surface which is continuous and patterned and which defines within the second foraminous member a plurality of discrete, isolated, deflection conduits (See FIGS. 11 and 12). The deflection conduits are continuous passages connecting the embryonic web-contacting surface with the opposite surface of the deflection member. The deflection member is constructed in such a manner that when water is caused to be removed from the embryonic web (as by the application of differential fluid pressure) in the direction of the foraminous member, the water can be discharged from the system without having to again contact the embryonic web in either the liquid or the vapor state. The network surface is essentially monoplanar and continuous so that the lines formed by the network surface form at least one essentially unbroken net-like pattern. The network surface defines within it the openings of the deflection conduits in the web-contacting surface of the deflection member.

The openings of the deflection conduits are in the form of irregular pentagons distributed in a regularly repeating array as illustrated schematically in FIG. 11. Referring to FIG. 11, reference numeral 42 illustrates the openings of the deflection conduits while reference numeral 41 indicates the network surface; angles alpha are about 120°; the dimensions of the irregular pentagons and their orientations are: A is about 0.026 inch; B is about 0.068 inch; C is about 0.045 inch; D is about 0.026 inch; and E is about 0.007 inch. An inch=2.54 cm.

The fourth step is deflecting the papermaking fibers in the embryonic web into the deflection conduits and removing water from the embryonic web through the deflection conduits to form an intermediate web of papermaking fibers. The deflecting is done under such conditions that the deflection of the papermaking fibers is initiated no later than the time at which water removal through the conduits is initiated. Deflection of the fibers is introduced by the application of differential fluid pressure to the embryonic web by exposing the embryonic web to a vacuum in such a way that the vacuum is applied to the second surface of the deflection member and the web is exposed to the vacuum through the deflection conduits. Fibers in the embryonic web are deflected from the plane of the embryonic web into the deflection conduits without destroying the integrity of the web.

The fifth step is predrying the web with a flow-through dryer (hot air dryer) well known to those skilled in the art until the predried web has a consistency of about 75%.

The sixth step is impressing the network pattern of the surface of the deflection member into the predried web to form an imprinted web by pressing the predried web against the surface of a Yankee drum dryer with the deflection member. The surface speed of the Yankee dryer is 0% to 20% less than the surface speed of the first foraminous member.

The seventh step is drying the imprinted web on the surface of the Yankee dryer (to which it has been adhered with polyvinyl alcohol) to a consistency of about 97%.

The eighth step is foreshortening the dried web by creping it from the surface of the Yankee dryer with a doctor blade.

The preferred papermaking fibers are northern softwood Kraft fibers. Some preferred wet strength resins are Kymene 557H polyamide-epichlorohydrin cationic wet strength resin manufactured by Hercules Incorporated of Wilmington, Del., used at a level of 15–40 pounds per ton of bone dry pulp. A more preferred wet strength resin is the one described above and disclosed in U.S. Pat. No. 3,700,623, supra. Other additives to the papermaking furnish preferably include 2–6 pounds carboxymethylcellulose (CMC) per ton of bone dry pulp and 0–20 pounds per ton Hercon 48 waterproofing material made by Hercules Incorporated of Wilmington, Del.

The tissue is normally collected in roll form (16), shown in FIG. 9, so that it can be unwound either by using a powered drive on the unwind roll or by pulling on the web. A device to control web tension usually is necessary because the paper is light in weight and somewhat elastic. It is important to use low web tensions throughout the system and to control these tensions accurately.

As previously stated, the density and softener absorptivity rate of this preferred tissue paper is different for each surface. The position of the paper on the unwind stand determines which surface of the paper will be oriented on the inside of the laminate. As shown in FIG. 9, each tissue paper ply is led from the unwind stand through a series of turning rolls and draw rolls as needed.

3. Powder Handling in the Making of the Article

Powders to be laminated into the cells (3) shown in FIG. 3 are stored in conventional hoppers (10*a*), as shown in FIGS. 9 and 10. As needed, they are carried to the mold-depositing drum (14) by any of a number of metering and conveying devices. Typically they can consist of screw conveyors, belt conveyors and vibratory conveyors. Simple metering devices such as vibration feeders, loss-in-weight feeders, rotary valves, fluidized air lines and weight belts can also be used, and the like are well known in the art. Both volumetric and gravimetric feeders can be used.

It is preferable to give the powders a velocity component similar to the depositing drum speed to minimize settling time. For this reason a curve on the bottom of the entry chute is often helpful. Overall velocity of the powder can be varied by the height of the chute. A belt conveyor can also be used to give the powder the desired velocity.

One of the key features of the process is the capability of adding two or more different powders (9 and 9*a*) to the laminated sheet as shown in FIG. 10. Loose fabric softener prills can be added as a powder. When two or more different powders are processed they are kept separated via dividers (10*b*) in the hopper (10*a*). They can be metered to separate rows on the embossed tissue and kept physically separated during processing through merchandising, sale and storage of the product. Thus, some storage-incompatible materials can be incorporated into the same article without loss in their effectiveness.

4. Mold-Depositing Drum

The mold-depositing drum incorporates the following features:

(a) The exterior of the drum is covered with the molds which consist of a series of square or rectangular cavities (distinguished from cavitied surface of paper) into which the paper can be embossed. (It should be noted that the "mold cavities" of the embossing apparatus are distinguished from the "tissue cavities" in the surface of one side of the preferred paper.) A large range in mold cavity sizes and shapes are possible. It was found that rectangular cells of from about 0.5 to 3 inches (13 to 76 mm) by 0.5 to 3.0 inches (13 to 76 mm) are especially suited for the process and for the performance of the finished laminated product.

(b) At the bottom of each mold cavity is a vacuum hole leading to the interior of the drum where there is a cavity in which the air is partially evacuated.

(c) Between each of the cavities on the drum surface are "land" areas preferably about ⅛ inch (3 mm)

wide on the top. The lands may contain a series of air blow holes which are connected to a supply of compressed air inside the depositing drum. Air blowing outwardly through these holes and through the covering tissue can help to keep the cup rim (5a) areas free from loose powder thus providing a clean surface on the tissue for bonding.

(d) The interior of the mold-depositing drum includes a series of duct-like vacuum holes (12') designed to connect the center of the mold cavities with vacuum and, similarly, air blow channels (8') in the land areas are connected with air pressure. These ducting holes and channels lead to the side of the drum and are so constructed that each row of mold cavities can be connected individually with vacuum and air pressure as needed.

Many different arrangements for the internal ducting are possible including large internal plenum chambers as well as ducting immediately below the drum surface. Such arrangements are limited only by the imagination. An added feature that is particularly valuable is a sliding or adjustable block in the ducting system to control the input positions on the depositing drum which are connected to specific rows of surface activities so that the supply of air and vacuum to the mold-depositing drum can be varied as needed.

Connecting the internal vacuum and air ducting to sources of vacuum and air pressure are sliding valves. Again, many types of valve systems are available to effect a tight seal of a moving part against a stationary one.

5. Embossing Drum

A drum with a soft rubber exterior like that shown in FIG. 6 is designed to contact the mold-depositing drum cavities such that when paper is applied on the depositing drum, the soft surface of the embossing drum stretches the paper into the cavities. The embossing drum may have surface patterns which match the mold despositing drums. In this case the two drums must run in synchronization. If a smooth, nonpatterned (soft) embossing roll is used, speed synchronization may not be needed and the embossing drum can be driven by the mold depositing drum.

An important feature of the mold embossing drum which incorporates either soft rubber-like exterior or hard surface patterns is that they can be adjustable so that the depth of the embossing can be carefully controlled. Typically, depths of up to about 0.50 inch (12.7 mm) can be used for the soft embossing and up to about 0.40 inch (10.2 mm) for the hard embossing, but deeper or more shallow embossing can be used to satisfy parameters such as laminate cell capacity and shape. The hard embossing roll is run in synchronization with the mold-depositing drum.

The shape of a raised embossing knob on the hard embossing roll is important to get maximum embossing depths but it was found that a knob of about 0.25 inch (6 mm) less than the mold cavity in both dimensions (MD and CD) worked well, particularly when the knob corners were rounded to give roughly a circular or elliptical cross sectional shape.

6. Depositing Drum Receiver

As shown in FIG. 10, a receiver section (26) can be built onto the top part of the mold roll depositing drum (14) as shown in FIG. 10. This is designed to contain several important parts.

(a) "Sides" (10c) to contain the powder when it is first added to the mold-depositing drum. These must be fitted closely to the mold-depositing drum to minimize air flow from the sides.

(b) A doctor knife (24) as shown in FIG. 9 to level the surface of the powder inside the cups; to clean powder from the cup rims (5a); and brush away higher piles of powder that might interfere with the bonding. It was found that this doctor knife (24) could be made of many materials, but a soft brush was particularly effective.

(c) As shown in FIG. 10, divider (10b) similar in shape to the sides of the hopper (10a) and receiver (26) but between the sides of the hopper and receiver (26) can be used to separate different powders and permit two or more completely different materials to be deposited and contained in the laminated product without being in physical contact with each other.

7. Softener Dot Immobilization and Bonding Systems

Although these two systems are discussed together, it will be understood that they are not necessarily linked together.

Referring again to FIG. 9, the top tissue web (4) is fed from a conventional unwind roll (16') using tension control provided by a simple dancer system. For this invention the high density cavitied surface of (4) would be up.

Ordinarily the tissue is pulled but if needed the unwind roll could be driven by a number of devices commonly used in web handling processes.

A gravure printing system (27) is used to print hot melt adhesive (22) on the top ply tissue web (4) in such a pattern as to match the cup rims and the lands of the mold-depositing drum cavities. Conventional gravure hot melt systems such as furnished by Roto-Therm Co., Anaheim, Calif. 92807 can be used.

As noted previously herein the laminated products can contain granules, prills or flakes of fabric softener within the laminate. Such granules are mobile within the laminate. In a preferred embodiment, the softener is immobilized in the form of dots which are bound to the interior surface of one or both of the exterior plies of the laminate or to a ply which lies between the exterior plies. These are referred to herein as immobilized softener dots.

Referring again to FIG. 9, a softener dot immobilization screen composition printing system roll (28) is used to apply a hot molten softener in patterned "dots" onto the high density cavitied surface of the tissue paper. The softener dots are printed on the open tissue that is free of the hot melt adhesive pattern, as illustrated in FIG. 15.

The temperature of the hot molten softener composition when applied is typically 49° C. to 88° C. The dots are shown immobilized on the inside surface of the top ply (4) of FIG. 3. They can extend into the tissue ply and extend above that surface from about 0 mm to about 10 mm, preferably from less than 1 mm up to about 3 mm, more preferably less than 2 mm.

From the softener dot immobilization screen printing roll (28) the paper is led over a roller to the depositing roll where an immediate hot melt adhesive bond is made on the lower tissue (5) oriented with its low density domed surface in. A more permanent bond is provided by passing the laminates under a laminating roll (23) where the paper web is compressed and the patterned adhesive driven deeply into the tissue structure.

The bonding system of FIG. 9 is a preferred method of bonding. It is understood that other systems of bonding are also satisfactory. For example, meltable fibers, such as polyester fibers, can be included in the paper furnish, which tissue is then heat sealable. The bonds along the cup rims can be achieved by patterned heating in these areas. Other bonding methods such as needle-punching, high pressure bonding and heat sealing using patterned meltable films are other possible modes of lamination.

Likewise, the above system of softener immobilization is only a preferred way of applying molten softener to the tissue ply. It is understood that other methods such as offset gravure printing, roll-coating, spray-on of molten softener and extrusion can be used to apply softener.

Again with reference to FIG. 9, the tissue is typically unwound from the roll (16) using only the pull from the mold-depositing roll (14). With stiffer paper, larger rolls, or if any sticking occurs it may be necessary to use driven unwind rolls or separate pull rolls to help unwind the paper. Tension on the paper is controlled with a simple dancer system.

The paper unwinding operation can cause a buildup of static charges on the web which can cause later problems with the power handling. This is usually dealt with by a combination of increasing ambient relative humidity to at least 50% and by using commercial static eliminators at the appropriate places near the web.

The oriented paper for the bottom ply is led to the mold-depositing drum (14) and through the nip of the embossing drum (13). Although not essential, having some vacuum on the cavities at this point helps to stabilize the paper and keep it in place during embossing, as well as preventing the somewhat elastic paper from shrinking back to enclose a lower volume after the embossing operation. The embossing drum (13) may be synchronized with the depositing drum and/or adjusted to the desired depth. Typically a depth of 7.6 mm to 12.7 mm is used for embossing.

At a position near the top of the depositing drum (14) of FIG. 9 powder (9) is added. This powder can be added to any part of the depositing drum if it is held by vacuum but about 15° before TDC (top dead center) works well. The powder is added preferably in a waterfall or cascade fashion across the entire web at a rate which matches the overall sheet requirements. For a 6-inch long sheet a powder level of 20 to 120 grams is often desired.

Referring to FIGS. 6, 7 and 8, concurrent with the powder addition both the vacuum (12') and the blow air (8) are turned on. The vacuum greatly aids the quick and accurate setting of the powder into the cavities. In the land area (**12*b*), air blows outwardly through the paper helping to keep the cup rim areas (5*a*) of FIGS. 2 and 3** clean for subsequent bonding. The amounts of air pressure and vacuum are controlled and balanced for best performance but typically a vacuum of about 200 to 1,000 mm of water and air pressure of 200 to 500 mm of water work well.

Referring again to FIG. 9, following the powder deposition the drum (14) rotates under a doctor knife (24) to level the powder in the cups.

Hot melt adhesive (22) is applied to the paper tissue (4) from a gravure cylinder (27) using the desired pattern. Many types of hot melts can be used including polyvinyl acetates, polyethylene, rubbers and the like. Polyamide glues have been particularly favored since they maintain their integrity through a laundering cycle. Solvent based adhesives are also acceptable for the process but need further processing to eliminate the solvent. Whatever type of adhesive is used it should have quick tack properties so the lamination is completed very rapidly. Typically, the hot melt glue is printed at about 420° F. The viscosity at this point is about 10,000 centipoises which tends to cause the adhesive to remain on or near the paper surface until it reaches the laminating (combining) roll (23).

The upper paper ply (4) with printed hot melt adhesive is led through the screen printing softener system (28 and 28') to the mold-depositing drum (14) where it combines with the lower paper ply (5) on the cup rim areas. With the proper adhesive, immediate light bonding is obtained. By then passing under a laminating combining roll (23) with bonding pressures up to 100 pounds per lineal inch the paper is compressed and the adhesive is forced deep into the paper for a permanent bond. Care must be taken to achieve deep penetration of the adhesive into the web so the plies will not delaminate at or near the bonds during storage and handling and especially the rigorous wash cycle. Compression of the laminated tissue paper bond areas to a total thickness of 0.13 to 0.65 mm is particularly effective. For adhesives with a very quick tack, it is preferable to move the lamination roll close to the point where the two paper plies are initially joined.

After combining, the laminated sheet is led from the depositing drum (14) to a slitting, cutting and folding operation to trim sheets to the final shape for usage as shown in FIG. 10.

It will be understood that a laminated article can be embossed on both sides for increased cell volume. It will also be understood that the size of the cells may be increased as shown in FIG. 15. It should also be understood that the product can be made manually or semi-manually.

THE LAUNDRY ACTIVES

The powders used in the present invention can be typical laundry actives: softener prills, bleaches, detergents, etc.

Examples of powdered detergent materials are disclosed in U.S. Pat. No. 4,404,128, B. J. Anderson, issued Sept. 13, 1983, incorporated herein by reference.

Examples of powdered bleach materials are disclosed in U.S. Pat. No. 4,473,507, F. P. Bossu, issued Sept. 25, 1984, incorporated herein by reference.

Examples of molten softener/antistatic mix materials are disclosed in U.S. Pat. No. 4,113,630, Hageret al., issued Sept. 12, 1978, and U.S. Pat. No. 4,259,373, Demessemaekers et al., issued Mar. 31, 1981, incorporated herein by reference. Other suitable fabric softeners such as amines, amides, fatty alcohols, etc., can be used.

EXAMPLE 1

A Preferred Tissue (Papermaking) Example

A pilot-scale papermaking machine was used. The headbox was a fixed roof suction breast roll former and the first foraminous member (fourdrinier wire) on which the embryonic web was formed was a 33×30 filaments per centimeter five-shed, woven polyester fabric.

The furnish was comprised of 100% northern softwood Kraft pulp fibers with about 13 kilograms of a wet strength resin per 1000 kilograms of bone dry fibers and about 3 kilograms of "CMC-T," Sodium Carboxymethylcellulose CMC-T papermaking additive per 1000 kilograms of bone dry fibers. (Sodium Carboxymethylcellulose CMC-T is manufactured by Hercules, Inc., of Wilmington, Del.) The wet strength resin of this example is the HCl stabilized reaction product epichlorohydrin and poly(N-methyldiallylamine hydrochloride), M.W. 468,000 described herein.

The resin is activated before use. Activation is accomplished by first adding water to dilute the resin if necessary to about 5% solids content. Then sodium hydroxide as a 50% solution is added to the 5% solids resin solution in an amount equal to about 2.5% of the weight of the 5% solution to activate the OR resin. The resin solution is properly activated if a 100 ml aliquot of solution reaches a bromothymol blue end-point when titrated with between 2 and 6 milliliters of one-normal sulfuric acid solution.

The activated resin of this example (referred to hereinafter as the resin of Ex. I) has a solids content of between 4.5% and 5.5%. This is added to furnish at a consistency of between 2.5% and 3.5%. Sodium Carboxymethylcellulose CMC-T in aqueous solution at a solids content of between 0.5% and 1.5% is also added to the furnish after the furnish is diluted to between 0.15% and 0.25% with recycled water from the web forming Fourdrinier section of the papermaking machine.

The web is transferred from the first foraminous member to a deflection member by applying vacuum to the surface of the deflection member opposite to the side of the deflection member to which the web is adhered by vacuum.

The deflection member is an endless belt having the preferred patterned network surface and deflection conduit geometry described in conjunction with FIG. 12. The paper made takes this conduit geometry having low density areas (domes 42) and a high density network region (41) as shown in FIG. 12. Here, angles alpha and beta are, respectively, 120° and 60°; and the dimensions of the rounded parallelograms and their orientations are: A is about 0.022 inch; B is about 0.086; C is about 0.069 inch; and D is about 0.023 inch. An inch=2.45 cm. The network surface of the deflection member is formed about a foraminous woven element made of polyester and having 25 (MD) by 25 (CD) filaments per centimeter in a simple (2S) weave. Each filament of the woven element is 0.15 mm in diameter; the fabric caliper is about 0.33 mm and its open area is about 39%. The combined network structure and foraminous woven element has a caliper of about 0.82 mm and the open area of the structure is about 35%.

The blow-through predryer is operated at a temperature of about 220° C. The Yankee drum is operated at a saturated steam pressure of about 8.8 kilograms per square centimeter.

The first foraminous member is operated at a speed of about 183 meters per minute and the deflection member at a speed of about 151 meters per minute. The paper is wound on a reel at a speed of about 137 meters per minute.

The consistency of the embryonic web at the point of transfer from the fourdrinier first foraminous member to the deflection member is about 15%. At the point of entering the blow-through predryer the consistency of the web on the deflection member is about 25% and at the point of discharge from the predryer and application to the Yankee dryer the web consistency is between 60% and 70%.

The web is transferred from the deflection member and adhered to the Yankee dryer through a combination of pressure applied by a nip-forming pressure roll to the deflection member from the side opposite to the web side and polyvinyl alcohol adhesive applied to the Yankee surface and the predried paper web.

The web is creped from the surface of the Yankee dryer with a doctor blade having an 84° angle of impact. The consistency of the web at the point of removal from the Yankee surface is about 97%.

The gross orientation of the fibers was adjusted by controlling the flow of dilute 0.15% to 0.25% consistency furnish to the headbox through adjustment of the flow rate of the pump supplying furnish to the headbox. The gross orientation was adjusted so that the ratio of dry tensile strength measured in the machine direction was between 1.5 and 2.1 times the dry tensile strength measured in the cross-machine direction.

Specific descriptions of the papermaking details are given in Table IA and the finished paper characteristics are given in Table IB.

TABLE 1A

Description of Paper Making Details Used in Example I
Wood Fibers - Northern Softwood Kraft

| | |
|---|---|
| Set Additives | |
| Wet Strength Resin of Example I | 25 lbs./ton (12.5 kg/1000 kg) |
| CMC-T | 6 lbs./ton (3 kg/1000 kg) |
| Basis Weight | 22.4 |
| Sheet Contraction | |
| Micro | 20% |
| Yankee | 10% |
| Refining Level | 60 Amps |

TABLE 1B

Example I Finished Paper Data

| | |
|---|---|
| Tensile Strength, dry | |
| MD | 1563 g/in. (615 g/cm) |
| CD | 1064 g/in. (419 g/cm) |
| Tensile Strength, wet | |
| CD | 458 g/in. (180 g/cm) |
| Stretch | |
| MD | 44% |
| CD | 21% |

EXAMPLES II–IV

Softener Dot Application and Laminate Making

Softener dots, the softener composition of which is described in Table 2, were immobilized onto the tissue of Example I using a gravure printing system for each of the oriented "topsheets" for laminates of Examples II–IV. The gravure system printed the molten softener onto the tissue in the dotted pattern illustrated in FIG. 15. The softener dots were each approx. 0.4 cm (0.16 in.) in diameter, dot height approximately 1.3 mm (0.05 in.) and 336 dots per 12-celled sheet, having a total weight of approx. 3.7 grams, were applied on each 15 cm×28 cm (6"×11") tissue sheet. The softener immobilized tissue paper ply sheet is then used as the "topsheet" in the two-ply paper laminate as shown in FIG. 15.

The other paper ply of the laminate is deeply embossed to a twelve-celled pattern similar to the one particularly shown in FIG. 15 forming twelve cups similar to the cups (2), as illustrated in FIG. 2. The twelve cups are embossed to a depth of approx. 1.0 cm (0.4 in.), each cup being approx. 3.8 cm (1.5 in.) wide and approx. 6.9 cm (2.7 in.) in length each with about 20 cc capacity. These formed cups (or pockets) are then filled with surfactant, builder, bleach, or other powdered laundry ingredients at least 8 of the cups are each filled with 9 grams (11 cc) of detergent and the other cups with at least one detergent adjunct (see Example XXIII for details). The topsheet ply with the dots on the inside of the laminate is attached to this filled, embossed paper ply by heat sealing with a sheet of polyethylene patterned to correspond to the rims of embossed ply. The topsheet ply is registered in such a way that no dots are in the areas which are sealed between the two plies.

As used herein, "paper orientation" refers to the surface of the ply which faces inward inside of the laminate, unless otherwise specified. The ply surface on which softener dots are immobilized, always faces inward of the laminate.

Figure 16:
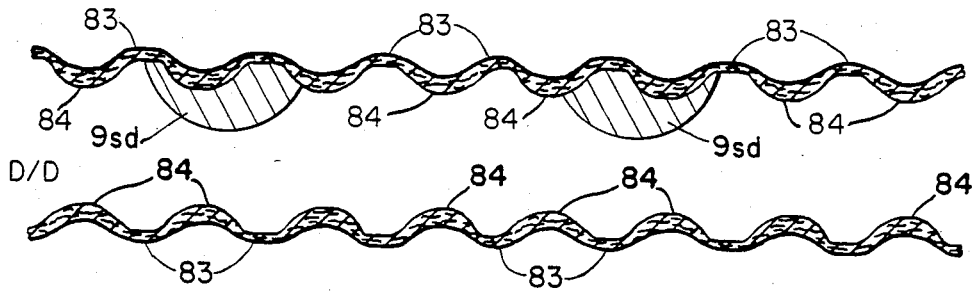
FIG. 16 is a magnified simplified cross-sectional view of a portion of a laminate as shown in FIG. 15 taken along the line 16—16 showing the "D/D" orientation of both paper plies with their low density domes facing inward of the laminate.
Figure 17:
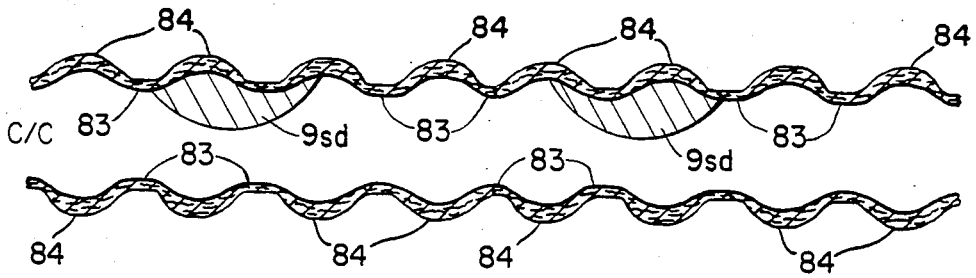
FIGS. 17 and 18 are similar to FIG. 16 but for different paper orientations C/C and C/D. The C/D orientation shown in FIG. 18 illustrates a mixed oriented paper laminate of this invention.
Figure 18:
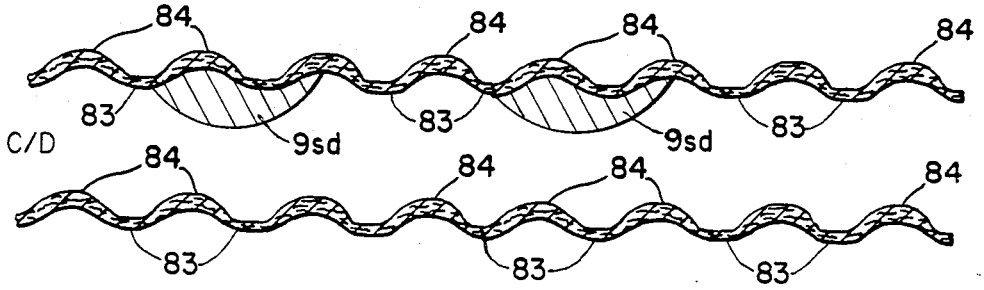

Three different laminated paper orientations are shown in FIGS. 16–18 which correspond to Examples II–IV. The top plies of these examples all have softener dots and the bottom plies are all embossed. Referring to FIG. 16, Example II shows a topsheet ply with approximately 3.7 grams softener dots are immobilized on the low density domed surface of the ply and the domed surface of the bottom ply is also facing the inside of the laminate. This is referred to as a dome/dome (D/D) orientation. Referring to FIG. 17, Example III shows the softener dots immobilized onto the high density cavitied surface of the topsheet ply while the cavitied surface of the bottom ply faces inward of the laminate. This is referred to as a cavity/cavity (C/C) orientation. In FIG. 18, Example IV, the softener is shown immobilized onto the cavitied surface while the domed surface of the bottom ply faces inside the laminate. This is referred to as a cavity/dome (C/D) orientation, wherein said "C" is the first ply and said "D" is the second ply of the C/D laminate. (Not shown is the D/C orientation of this invention which will appear in subsequent examples.)

Laminates of each of Examples II–IV are used to wash 3 kg (6½ pound) bundles in conventional washing machines using 49° C. (120° F.) water and 14 minute wash cycles. Each wash cycle is followed by a normal 27° C. (80° F.) rinse cycle. It is estimated that more than half of the softener composition survives the wash and rinse for potential release in the dryer. The washed bundles, along with the laminates, are then placed into conventional dryers that are roomed within a constant temperature and humidity room (approx. 22° C. (72° F.) and about 14% relative humidity). The bundles are dried on a normal cotton cycle for 45 minutes followed by a 10 minute cool down cycle. Each complete dried bundle is then placed within a Faraday cage and the fabrics removed individually while static measurements are taken. Lower voltage readings mean better static control within the dryer. The number of fabrics that cling together are also recorded, the lower cling number translating to better static control. The testing is done in triplicate. The average results of the three tests for each of the three different laminate orientations are shown in Table 3.

TABLE 2

| Softener Composition | |
|---|---|
| Ditallowdimethylammonium methylsulfate | (42.5%) |
| Sorbitan monostearate | (21.25%) |

TABLE 2-continued

| Softener Composition | |
|---|---|
| Cetyl alcohol | (21.25%) |
| Clay | (12%) |
| Perfume | (3%) |

TABLE 3

Static Control as a Function of Paper Orientation*

| Example | Softener Ply/Embossed Ply | Static (mV) | Clings |
|---|---|---|---|
| II | Domed/Domed (D/D) | 59 | 1.0 |
| III | Cavitied/Cavitied (C/C) | 88 | 3.3 |
| IV | Cavitied/Domed (C/D) | 24 | 0 |

*As used herein, "Orientation" refers to the direction of the low density domed (D) surface or the high density cavitied (C) surface of a ply which faces inwardly toward the other ply of the laminate.

It should be noted that the laminate of Example IV with the C/D orientation of this invention dramatically reduced the static as compared to the prior art C/C orientation.

EXAMPLES V–VIII

Laminate products were made as in Example II. Softener dots, as described, were immobilized onto the topsheet ply and the laminate was assembled as follows. Two different laminate orientations were made, D/D and C/D. Examples V, VI and VII all were of the D/D orientation. About 4.5, 4.0 and 3.5 grams of softener dots were respectively added to the domed surface of the topsheet ply of Examples V–VII.

Example VIII was of the C/D orientation. Approximately 3.7 grams of softener were immobilized onto the cavitied surface of the first ply or topsheet of this laminate. All laminates were assembled with the softener dots facing inward of the laminate. In both orientations, the domed surface of the embossed second ply faces the topsheet inside of the laminate. The washer and dryer procedure test was the same as in Examples II–IV, except that three different sets were run with the following wash and rinse temperatures: 16° C. (60° F.) wash/16° C. (60° F.) rinse; 35° C. (95° F.) wash/16° C. (60° F.) rinse; 49° C. (120° F.) wash/27° C. (80° F.) rinse. In separate runs for each test, a commercially available fabric softener sheet was added to the dryer only as a control. The values reported in Table 4 show the average mV readings vs. the control taken over this same time period. A number below 1.0 indicates better static control than the control. It should be noted from the data in Table 4 that the orientation represented by having the softener immobilized onto the cavitied surface for mixed orientation of this invention allowed superior static control at lower softener loadings particularly under the hot (49° C./120° F.) water wash condition.

TABLE 4

Static Control as a Function of Softener Level and Wash Temperature

| Ex. I | Orientation | Softener Weight | Static Control (vs. Control) 60° F. | 95° F. | 120° F. | Avg. |
|---|---|---|---|---|---|---|
| V | D/D | 4.5 grams | 0.51 | 0.54 | 1.02 | 0.69 |
| VI | D/D | 4.0 grams | — | — | 1.13 | — |
| VII | D/D | 3.5 grams | — | — | 1.15 | — |
| VIII | C/D | 3.7 grams | 0.61 | 0.61 | 0.84 | 0.69 |

D/D = Softener on dome surface
C/D = Softener on cavitied surface

It should be noted that the C/D oriented laminate of this invention (Example VIII) delivered superior static control vs. Example V on a weight vs. weight basis, particularly noticeable at the 120° F. (49° C.) temperature.

EXAMPLE IX-XII

Dryer Release for Immobilized Softener Dots

The laminates of this set were prepared in the same manner as described in Examples II-VIII, however, only approx. 3.5 grams of immobilized softener dots were contained within the laminated piles. Even though the bottom plies were embossed, no other laundry active was used. The weights of thee laminates were carefully recorded. Four different laminate orientations were tested, as described in Table 5. These laminates were wetted, then each was added to a dryer with a prewetted 3 kg (6½ pound) bundle and dried on a normal cotton cycle for 45 minutes. After the dryer cycle, each laminate was removed and the after dryer weight recorded. Table 6A shows the percent weight loss for the different orientations of the paper laminates. It is assumed that the greater the release of softener, the greater the ability to control static.

TABLE 5

| Laminate Orientations | | |
|---|---|---|
| Ex. | Orientation | Softener Ply/Embossed Ply |
| IX | D/D | Domed/Domed |
| X | C/C | Cavities/Cavities |
| XI | D/C | Domed/Cavities |
| XII | C/D | Cavities/Domed |

TABLE 6A

| Dryer Release for Immobilized Softener with Bottom Ply Embossed | | |
|---|---|---|
| Ex. | Orientation | % Release |
| IX | D/D | 11.5 |
| X | C/C | 12.2 |
| XI | D/C | 13.9 |
| XII | C/D | 12.6 |

It can be seen from Table 6A that the two "mixed" orientations (C/D and D/C) of laminate plies gave the greatest release of softener.

EXAMPLE XIII-XVI

Dryer Release for Laminated Loose Softener Flakes

Laminates were made as in Examples IX-XII. As in those examples no other laundry actives were added to the laminates, but for the softener. In these examples, about 4 grams of loose softener flakes (the fraction sieved through 12 mesh screens and onto 30 mesh), was equally divided among the 12 embossed laminate cells. The same four different orientations described in Table 5 were used for the laminates of these examples. These laminates were wetted and then individually, along with a 6½ pound prewetted laundry bundle, placed within a conventional dryer. A normal cotton dryer cycle was used for 45 minutes. After the dryer cycle, the laminates were removed and then weighed. The percent weight loss, which represents the dryer release of the softener, was then recorded. Table 7 shows the average results for 4 repetitive runs of each different laminate.

TABLE 7

| Dryer Release of Loose Softener Flakes | | |
|---|---|---|
| Orientation | Ex. | % Release |
| D/D | XIII | 12.0 |
| C/C | XIV | 14.4 |
| D/C | XV | 22.1 |
| C/D | XVI | 16.3 |

Once again, it was shown that the "mixed" orientations, C/D and D/C, released higher percentages of softener than the C/C and D/D orientations. It should be noted that Example XV with the D/C orientation with an embossed "C" was the overall superior laminate for softener release. The C/C orientation with loose softener flakes is prior art, but the C/C orientation with immobilized softener dots is not believed to be in the prior art.

EXAMPLES XVII-XX

In these Examples about 3.5 grams of softener dots were applied to each top sheet ply and a non-embossed "bottom" ply was used for each laminate instead of an embossed ply. The results are reported in Table 6B. Again, more softener was released in the dryer for each of the mixed oriented (D/C and C/D) laminates.

TABLE 6B

| Dryer Release of Softener Dots with Nonembossed Second Ply | | |
|---|---|---|
| Orientation | Ex. | % Release |
| D/D | XVII | 7.8 |
| C/C | XVIII | 7.4 |
| D/C | XIX | 8.9 |
| C/D | XX | 9.1 |

It appears from all of the above data that the mix orientation "D/C" of Examples XI and XV each with an embossed bottom ply is a more preferred embodiment of this invention. Also, in both mixed orientations, C/D and D/C, one of the plies is more readily absorbent to molten fabric softener than the other ply.

EXAMPLES XXI and XXII

Laminates with Plastic Film

Three-ply laminates were made each using a tissue ply of Example I with about 3.5 g softener dots, an impermeable polyethylene plastic (P) sheet middle ply and a tissue for a third ply for laminating ease. The third ply was nonfunctional. One of the laminates had the first ply oriented with its cavities facing inward of the laminate and the other with domes facing inward, abbreviated, respectively, C/P and D/P. The results are shown in Table 8.

TABLE 8

| Ex. | Orientation | % Release |
|---|---|---|
| XXI | C/P | 18.7 |
| XXII | D/P | 13.3 |

Thus, the more preferred orientation is the C/P over the D/P. It appears that the "C" orientation allows greater molten softener to flow out of the laminate than the "D" orientation.

Method of Use

The method of using the article of this invention is given below. The amount of laundry actives and softener composition are the same as Example VIII with the orientation C/D. The materials of the detergent mix and the bleach mix are each separately blended and added to separate rows of the embossed tissue (5). The tissue in this example was embossed with a soft embosser (13) illustrated in FIG. 6. In this case the embossing stretch was about 30% to 40%. The embossing stretch here is distributed more uniformly over the total area of the embossed part of the tissue.

Laminated laundry articles like the one shown in FIG. 15 are made by hand. Each sheet contained 12 cells, each approximately 2.7×1.5×0.4 inches (6.9×3.8×1.0 cm), about 102 g of detergent and bleach and 3.7 g of immobilized softener dots. The paper used is that paper hereinbefore described in Example 1.

The article contained 8 cells of the detergent and 4 cells of the bleach mix. Each of the detergent cells contained about 9 g of detergent which is about 12 cc of powder. Each of the bleach cells contained about 7 g bleach which is about 11.5 cc of bleach powder. The softener and level of use is set out above in Example II. The total amounts of other laundry actives laminated in each sheet are set out below.

EXAMPLE XXIII

The following granular detergent composition was prepared.

| | Base Granules | |
|---|---|---|
| | Weight % | Grams Final Composition Per Use |
| Sodium $C_{13}$ linear alkylbenzene sulfonate | 22.1 | 5.110 |
| Sodium $C_{14-15}$ alkyl sulfate | 22.1 | 5.110 |
| Sodium silicate (1.6 ratio) | 13.7 | 3.172 |
| Sodium sulfate | 32.2 | 7.455 |
| Polyethylene glycol (MW = 8000) | 1.5 | 0.340 |
| Sodium polyacrylate (MW = 4500) | 2.0 | 0.453 |
| $C_{12-13}$ alcohol polyethoxylate (6) | 3.0 | 0.680 |
| Sodium diethylenetriamine pentaacetate | 1.5 | 0.340 |
| Moisture | 2.0 | 0.462 |
| | | 23.122 |
| Preblend | | |
| Base granules | | 23.122 |
| Sodium tripolyphosphate hexahydrate (powdered) | | 20.576 |
| | | 43.698 |
| Admix | | |
| Preblend | | 43.698 |
| Sodium tripolyphosphate hexahydrate (granular) | | 19.429 |
| Dye | | 0.003 |
| Brightener | | 0.613 |
| Suds suppressor prill comprising dimethylsilicone, silica, sodium tripolyphosphate and polyethylene glycol (MW = 8000) | | 1.703 |
| Protease | | 2.044 |
| Sodium carbonate | | 4.000 |
| | | 71.490 |
| Spray-On | | |
| Admix | | 71.490 |
| Mineral oil | | 0.710 |
| | | 72.200 |

The base granules were produced by sray-drying an aqueous crutcher mix of the components on a ten foot tower using a crutcher temperature of 200° F., a size 3½ nozzle to make fine granules, and silicone deaeratants. If the base granules contained more than 2% moisture, a second drying stage on a continuous fluid bed was performed to reduce moisture to 2%.

The base granules were then admixed with powdered STP hexahydrate to form the preblend. The preblend was compacted at 50 psig roll pressure on a 4 in. by 10 in. chilsonator, and screened to select a −14(1168 microns)/+65(208 microns) particle size cut (Tyler mesh). Oversized particles were collected and granulated on a Fitzmill using a 14 mesh screen and low rpm's. This was screened to select a −20(833 microns)/+48(295 microns) particle size cut. Both materials were dedusted by blowing off fines in a fluid bed dryer using ambient air.

The admix was prepared at 400 pounds per batch in a drum mixer. Carbonate, granular STP (with dye sprayed-on), brightener, enzymes, and suds suppressor prills were blended with the compacted mainstream product cut and regranulated overs. the ratio of mainstream product cut to overs was 7 to 1. Mineral oil was sprayed on the final admix in 30 to 40 pound batches at a 1% level using a Forberg Mixer.

The selection of paper and cell size insures the flow of water into the laminates and the flow of dissolved and suspended powders through the paper tissue. The laminated product powders are introduced into the washer before the clothes. By dividing the total amount of powder into 12 separate compartments, all the powder come into contact with water very rapidly which is important to keeping total dissolution time to a minimum. About 40–90% of the softener survives the wash for release in the dryer.

At the end of the rinse cycle, the laminates were examined and found to be substantially intact with softener dots. The powders had dissolved. The paper was wrinkled but untorn. The laminated sheets was not removed from the load of wet fabrics at this stage, but was carried along with the fabrics to the dryer. The laminate was dried with the rest of the fabrics. No problem was encountered in the dryer. The spent dried laminate was easily separated from the rest of the fabrics after the drying operation. Examination of the spent sheet showed the sheet was still intact after the drying cycle.

Summary of Method of Use

In a preferred embodiment, the laundry article is packaged in association with printed instructions, e.g., on the package, instructing the user to add the article sheet to the washing machine before adding the clothes. The following is an illustration of such instructions:

Step 1. Use correct amount: 1 full sheet (e.g., a 12-celled article illustrated by FIG. 15 with a perforation (50)) for a normal capacity washer load; 1½ sheet for large washers or heavily soiled loads; ½ sheet (6 cells) for small loads.

Step 2. Wash: Add sheet to washer before clothes. Sort white, light colored and dark loads. Do not overload clothes in washer. Select wash cycle and water temperature. Nylon, acetate and other delicates should only be washed in cold water to keep clothes new and bright.

Step 3. Dry: Load wet clothes with same sheet into dryer. Discard sheet at end of dryer cycle.

The article of this invention can be designed so that no additional bleach, detergent or softener need be added to the laundry operation with maximized softener performance with the mixed oriented paper laminates disclosed herein.

What is claimed is:

1. A flexible water-permeable laminated laundry article comprising two insoluble laminated plies, with fabric softener composition releasably contained within said laminate, wherein one of said plies is a first ply which comprises a paper tissue having a distinct continuous high density network region and a plurality of low density domes dispersed throughout said network region, said domes being protuberances when viewed from one surface of said tissue paper and cavities when viewed from the opposite surface, wherein said high density network region is more readily absorbent to said fabric softener when said fabric softener is molten than the low density domes; wherein said first ply is oriented (C) with its low density domes facing outwardly and its cavities facing inwardly of the laminate, and wherein said second ply is a suitable sheet selected from: tissue paper, nonwoven fabrics, plastic films and woven fabrics, and wherein said second ply is less readily absorbent to said molten fabric softener than said oriented first ply; and wherein when said second ply is a paper tissue having low density domes and said cavities, said second ply is oriented (D) with its domes facing inwardly of the laminate.

2. The laundry article of claim 1 wherein said second ply is also a paper tissue.

3. The laundry article of claim 1, wherein said high density network region has a density of from about 0.40 to about 0.80 g/cc and said low density domes have a density of from about 0.04 to about 0.15 g/cc.

4. The laundry article of claim 3 wherein the density of said high density region is about from 0.50 to about 0.70 g/cc and the density of said domes is from about 0.06 to about 0.10 g/cc.

5. The laundry article of claim 1 wherein said tissue paper has a basis weight of from about 15 to 30 lbs per 3,000 sq. ft. (24–49 g/m$^2$).

6. The laundry article of claim 1 wherein said tissue has a basis weight of from about 20 to about 25 lbs. per 3,000 sq. ft. (32–41 g/m$^2$).

7. The laundry article of claim 1 wherein said paper has a dry caliper of from about 10 to about 35 mils (0.25–0.89 mm).

8. The laundry article of claim 1 wherein said tissue has a dry caliper of from about 20 to about 30 mils (0.51–0.76 mm).

9. The laundry article of claim 1 wherein said tissue first ply has air permeability of from about from about 100–300 SCFM.

10. The laundry article of claim 1 wherein the fabric softener composition contains a mixture of cationic and nonionic softener/antistatic materials.

11. The article according to claim 1 wherein said fabric softener comprises an effective amount of an intimate mixture of a softener/antistatic composition having a maximum solubility in water of 50 ppm at 25° C. and a melting point of from 100° to 200° F. comprised of:

(a) from about 10% to 90% by weight of quaternary ammonium fabric conditioning compounds having the formula $[R_1R_2R_3R_4N]^+Y^-$, wherein at least one, and not more than two, of the $R_1$, $R_2$, $R_3$ or $R_4$ groups is an organic radical containing a group selected from a $C_{12}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxy alkyl, and cyclic structures in which the nitrogen atom forms part of the ring, Y constitutes an anionic radical selected from the group consisting of hydroxide, halide, sulfate, methyl sulfate, and phosphate ions; and (b) from about 10% to 90% by weight of a dispersion inhibitor, being a solid organic material having a maximum solubility in water of 50 ppm at 25° C. and a softening point in the range of 100° to 200° F., said material being selected from the group consisting of paraffinic waxes, cyclic and acyclic mono- and polyhydric alcohols, substituted and unsubstituted aliphatic carboxylic acids, esters of cyclic and acyclic mono- and polyhydric alcohols and acids, condensates of $C_2$–$C_4$ alkylene oxide with any of the foregoing types of materials, whether or not said materials themselves meet the above solubility and softening point limits, and mixtures thereof.

12. The article according to claim 11 wherein said intimate mixture penetrates into at least one of said plies.

13. The article according to claim 12 wherein the laminate contains from about 0.2 to about 12 grams of the intimate mixture.

14. The article according to claim 13 wherein the intimate mixture occupies a total of at least about 1.5 square inches of the ply surface area.

15. The article according to claim 11 wherein the weight ratio of quaternary ammonium compound to dispersion inhibitor is in the range of from about 4:1 to 1:4.

16. The article according to claim 11 wherein the weight ratio of quaternary ammonium compound to dispersion inhibitor is in the range of from about 3:1 to 1:3.

17. The article according to claim 12 wherein the intimate mixture occupies at least about 3 square inches of the ply surface area.

18. The article according to claim 12 wherein the intimate mixture covers at least about 4 square inches of the ply surface area.

19. The article according to claim 12 wherein the intimate mixture is in the form of softener dots which extend above the inside surface of said at least one ply to a height of from about zero to less than about ⅜ inch.

20. The article according to claim 19 wherein said ply carries from about 0.25 to about 9 grams of the intimate mixture.

21. The article according to claim 20 wherein the substrate carries from about 1.0 to about 6 grams of the intimate mixture.

22. The article according to claim 21 wherein the intimate mixture is formed by comelting the quaternary ammonium compound and the dispersion inhibitor.

23. The article according to claim 22 wherein the quaternary ammonium compound is selected from the group consisting of ditallowalkyldimethylammonium chloride, ditallowalkyldimethylammonium methylsulfate, and dioctadecyldimethylammonium chloride.

24. The article according to claim 11 wherein the dispersion inhibitor is selected from the group consisting of $C_{10}$–$C_{22}$ fatty alcohol, $C_{10}$–$C_{22}$ alkyl sorbitan esters, and mixtures thereof.

25. The article according to claim 19 wherein the intimate mixture are in the form of softener dots which extend above the ply surface to a height of from about 1/32 inch to about ¼ inch.

26. The article according to claim 25 wherein the ply carries at least about 3.5 grams of the intimate mixture.

27. The article according to claim 25 wherein the laminate additionally contains a laundry detergent composition comprising from about 5% to about 95% of a water-soluble surface-active agent.

28. The article according to claim 1 or 11 wherein said fabric softener intimate mixture is contained in said laminate as loose flakes.

29. The article according to claim 1, 11 or 27 wherein said article is designed for through the wash and dryer use.

30. The article according to claim 1, or 11 wherein said fabric softener composition comprises patterned immobilized dots on said first ply and said second ply comprises an embossed tissue having a multiplicity of nonconnecting cups so as to form a multiplicity of sealed cells.

31. The article according to claim 1, or 11 wherein said fabric softener composition comprises patterned immobilized dots on said second ply and said first ply is embossed so as to form a multiplicity of cells.

32. The article according to claim 31 wherein said article contains at least one other laundry active contained inside of embossed cells.

* * * * *